US006129032A

United States Patent [19]

Migliorini

[11] Patent Number: 6,129,032

[45] Date of Patent: Oct. 10, 2000

[54] METHOD AND APPARATUS FOR SEWING TEXTILE ARTICLES

[75] Inventor: Pier Lorenzo Migliorini, Terranuova Bracciolini, Italy

[73] Assignee: Matec S.p.A., Italy

[21] Appl. No.: 09/287,419

[22] Filed: Apr. 7, 1999

[30] Foreign Application Priority Data

Apr. 8, 1998 [IT] Italy ..... FI98A0084

[51] Int. Cl.[7] ..... D05B 21/00

[52] U.S. Cl. ..... 112/475.12; 112/470.12

[58] Field of Search ..... 112/475.12, 475.07, 112/470.08, 470.07, 470.06, 470.12, 470.13, 470.15

[56] References Cited

U.S. PATENT DOCUMENTS

| | | | |
|---|---|---|---|
| 4,303,026 | 12/1981 | Ueda . | |
| 4,444,140 | 4/1984 | Moyer . | |
| 5,058,516 | 10/1991 | Maegawa et al. | 112/470.15 |
| 5,345,889 | 9/1994 | Gazzarrini et al. . | |

*Primary Examiner*—Peter Nerbun

*Attorney, Agent, or Firm*—McGlew and Tuttle, P.C.

[57] ABSTRACT

Method and apparatus for sewing textile articles, according to which provision is made for moving a sewing machine from and to article-supporting shapes, so as to cause the legs of the articles to be sewn to transit through an optical control port facing the needle of a seamer and extending in a direction substantially orthogonal to that of transit of the articles in the process of formation.

4 Claims, 3 Drawing Sheets

METHOD AND APPARATUS FOR SEWING TEXTILE ARTICLES

FIELD OF THE INVENTION

The present invention refers to a method and apparatus for sewing textile articles.

BACKGROUND OF THE INVENTION

It is well known that in order to carry out a correct sewing of two articles, these must be properly positioned with respect to means which operate the sewing. For example, to make pantyhose articles, provision is made for assembling two stockings, that is, two knitted tubular articles whose portion in correspondence of the bodice is to be cut longitudinally over a predetermined length and then sewing the articles together in correspondence of the thus cut legs. To this end, the stockings intended to form the pantyhose article are fit on corresponding paired flat support shapes which allow the same stockings to move between loading, positioning, cutting, sewing and unloading stations of a horizontal carrousel machine so-called "pantyhose seamer" or "line-closer". Pantyhose-assembling machines which operate in a manner set forth above are described in the U.S. Pat. Nos. 4,444,140, 5,345,889 and 4,303,026.

Under operating condition, the seamers of these known machines are subjected to continuous motion from and to the articles under formation by means of a mechanical transmission provided with a cam which controls the motion of the support of same seamers. In this way, the seamers are driven, during the articles-sewing step, according to a preset and unchanging scheme. It thus follows that the sewing is always performed in the same way, even if the articles under formation are badly positioned, which hardly allows meeting the requested quality.

SUMMARY AND OBJECTS OF THE INVENTION

The main object of the present invention is to overcome the said drawback. This result has been achieved, according to the invention, by providing an apparatus and implementing the method disclosed independent claims. Further characteristics being set forth in the dependent claims.

The advantages deriving from the present invention lie essentially in that it is possible to continuously control, and possibly correct each time, the position of the articles under work with respect to the sewing means. This can occur regardless of the elastic shrink of the article when it is a matter of making pantyhose articles from stockings, the elastic shrink of the bodice's portions thereof towards the relevant shapes after the longitudinal cut of same portions is not problematic and an existing sewing machine can be used without the need of modifying their mechanical and functional construction. It is also possible to indirectly carry out a quality control of the various steps for the assembling of the pantyhose articles. An apparatus according to the invention is simple to make, cost-effective and reliable even after a prolonged service life. These and other advantages and characteristics of the invention will be best understood by anyone skilled in the art from a reading of the following description in conjunction with the attached drawings given as a practical exemplification of the invention, but not to be considered in a limitative sense.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiment of the invention are illustrated.

DESCRIPTION OF THE PREFERRED EMBODIMENTS

Figure 1A:
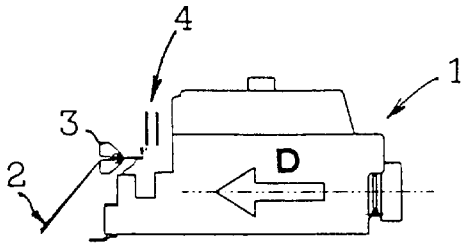
FIGS. 1A–1B and 1C–1D show a sewing machine associated to a control apparatus according to the invention, with the stockings badly fit with respect to the seamer, in a plan view and a side elevation view, respectively, FIGS. 1A and 1C representing also the occurrence of an excessive elastic shrink of the articles towards the respective shapes.

The description that follows, with reference to the case of two stockings to be joined to form a pantyhose article, applies equally to the sewing of any pair or assembly of textile articles. The seamer (1) may be of any type available on the market, for example, it may be a sewing machine of "Union-Special" type.

The stockings (2) in the process of being sewn, are shown on the respective paired support shapes (3), already loaded, positioned and cut in a way known to those skilled in the art. The said shapes (3) are those of a pantyhose-assembling machine of "line-closer" type.

What is exemplarily illustrated in the figures of the attached drawings applies to the case in which the shapes (3) are moved relative to the seamer (1), in the direction indicated by the arrow (F). However, the following description applies also to the case in which only the seamer (1) is moved in a direction opposite to that of arrow (F), and to the case in which both the shapes (3) and the seamer (1) are driven into motion, so that the relative movement between the shapes (3) and the seamer (1) will result in any case in the direction indicated by the arrow (F).

The sewing of the stockings (2) is obtained, therefore, from the advancement, of the respective legs (20) to be sewn, with respect to the needle (10) of the seamer (1), to which a cutter (11) to cut the surplus fabric and a relevant hose (12) for aspirating the waste are associated.

Figure 1B:
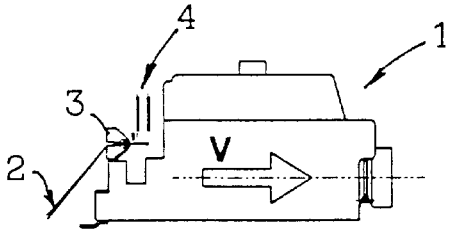
Figure 1C:
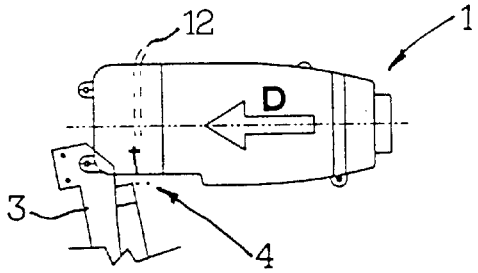
Figure 1D:
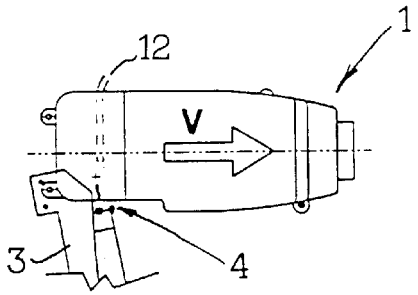
Figure 3:
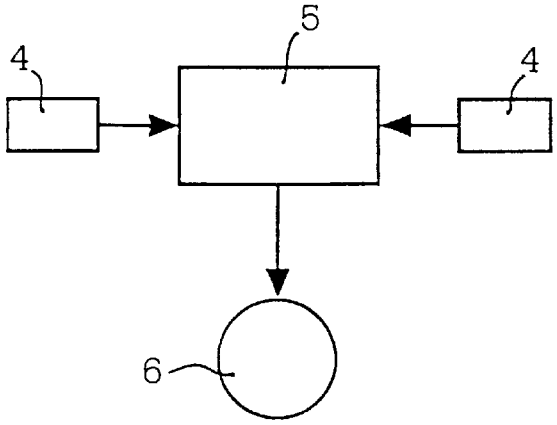
FIG. 3 is a simplified block diagram of the optical control system.
Figure 2A:
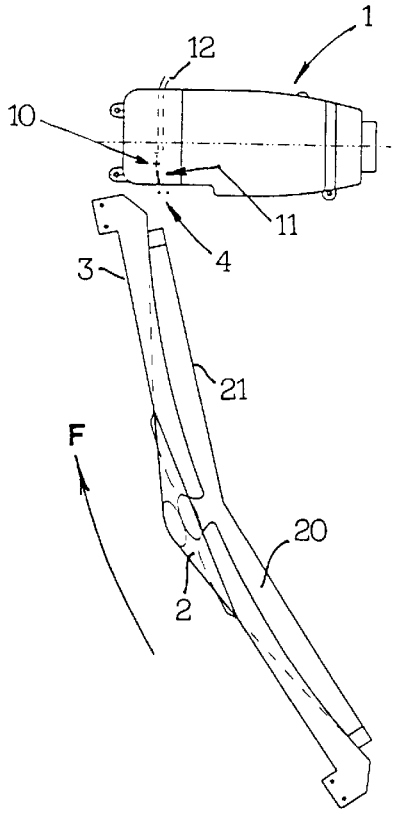
FIGS. 2A–2F are diagrammatic plan views of a sewing machine provided with a control apparatus, according to the invention, being shown at successive work positions midway of the stroke for sewing two stockings which are to form a pantyhose article, and with the two stockings being properly positioned with respect to the seamer.
Figure 2B:
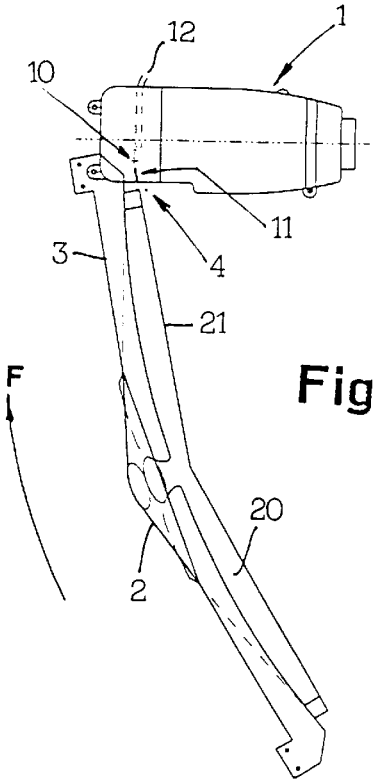
Figure 2C:
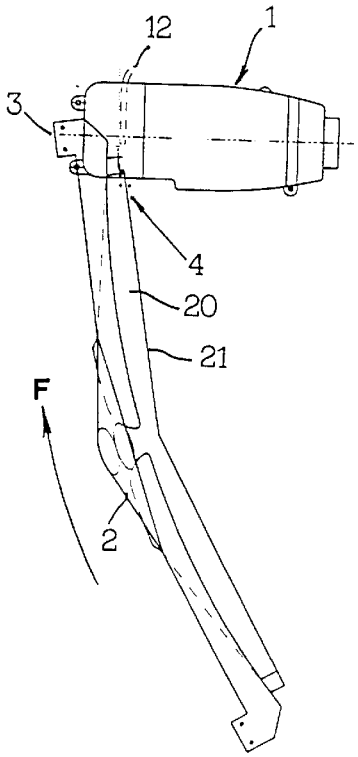
Figure 2D:
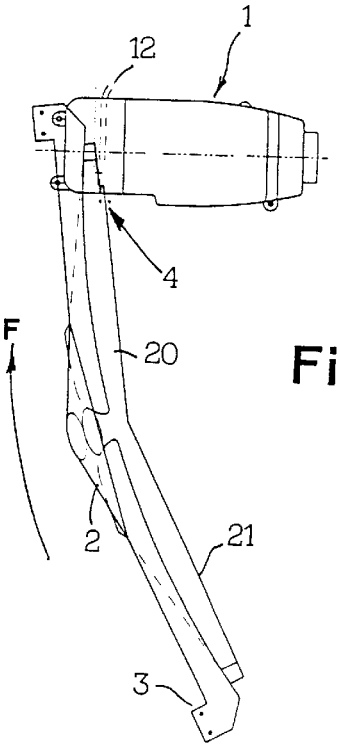
Figure 2E:
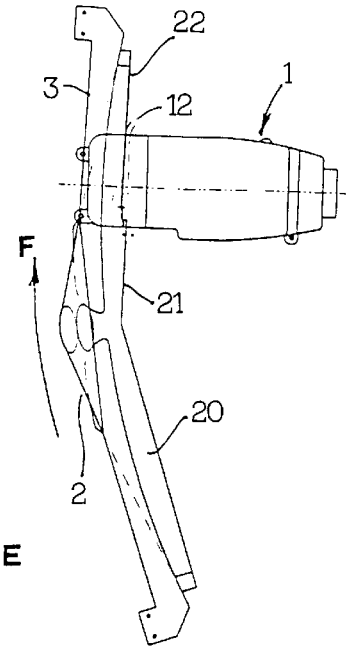
Figure 2F:
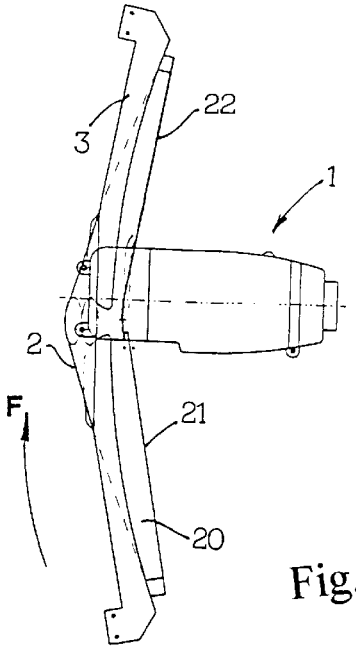
Figure 4:
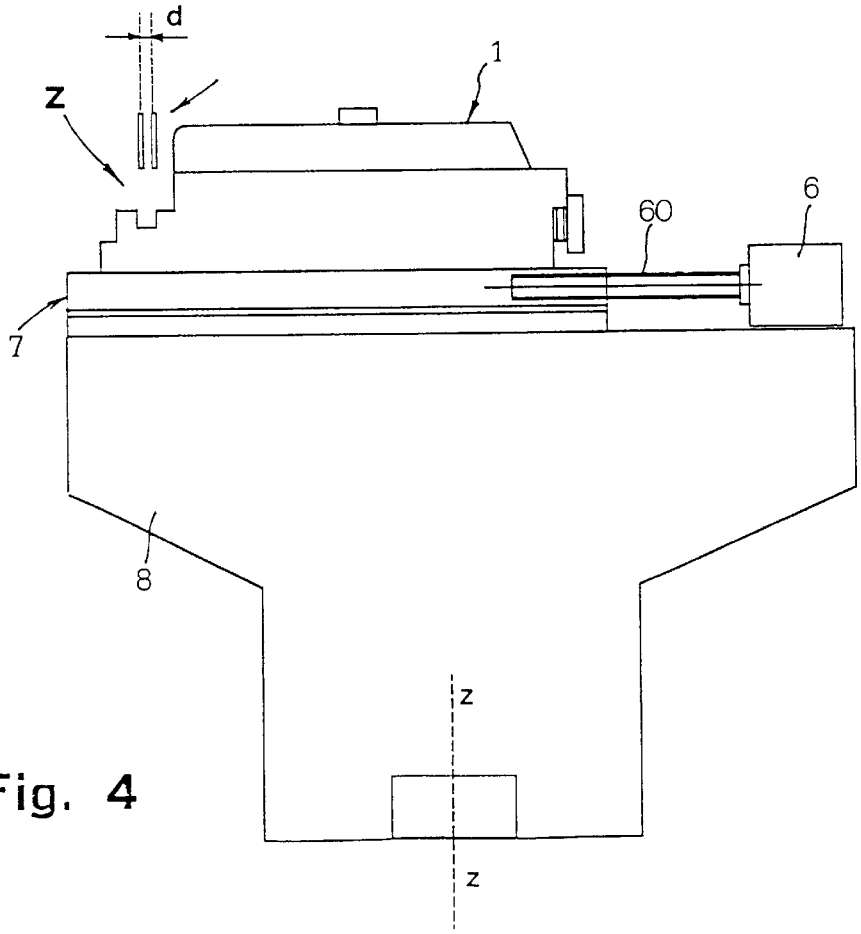
FIG. 4 is a schematic side elevation view of a semar provided with the apparatus, according to the invention, mounted on the relevant support.

The operating method according to the invention includes keeping the outer edge (21), of the legs (20) of articles (2) to be sewn, within an optical control region or port (z) facing said needle (10) and extending in a direction substantially orthogonal to that of advancement of the articles (2). The present method also includes moving the seamer (1) from and to the advancing articles (2), in a directions (D), and (V), respectively to the direction (F) of advancement of the articles (2), when said control region or port (Z) is completely intercepted by (see FIGS. 1B, 1D), and respectively cleared of (see FIGS. 1A, 1C), the articles (2) in the process of formation. In other words, when the articles under work are so positioned as to have the edge of the respective legs (20) to be sewn far away from the control port (Z), as illustrated in FIGS. 1A and 1C, the seamer (1) is moved close to the shapes (3) so that said edge (21) of articles (2) will result inside the port (Z). When, instead, the edge (21) of the articles (2) under work is beyond the control port (Z), as illustrated in FIGS. 1B and 1D, so that the fabric of the articles intercepts the port (Z) over the whole width (D) of the latter, the seamer (1) is moved away from the shapes (3) to achieve the effect above described. In this way, the junction of the articles (2) is carried out along a line (22) for optimal sewing, regardless of how far the legs (20) of articles (2) protrude from the shapes (3).

The width (d) of the optical control port (Z) can be varied at will, that is, in relation to the conformation of the articles (2) to be worked.

With reference to the example illustrated in the figures of the attached drawings, the apparatus according to the invention comprises a pair of photocells (4) located in correspondence of said control port (Z) which thus results delimited by the optical axes of the two photocells (4).

The said photocells (4) are connected to a programmable electronic unit (5) to which a step-by-step motor (6) is associated, the shaft of said motor being connected to a worm screw (60) acting on a linearly moving slide (7) which supports the seamer (1). The slide (7), in turn, rests on a base structure (8) either stationary or movable—that is, rotating about a corresponding vertical axis (z-z) under control of a corresponding driving member, not shown in the figures of the attached drawings—depending on whether the relative movement (F) between the shapes (3) and the seamer (1), during the sewing of the articles, derives only from the movement of the shapes (3) (as illustrated in the FIGS. 2A–2F) or also from the rotation of the support (8) of the seamer (1).

In the place of the photocells (4), any other equivalent device may also be used.

As previously mentioned, the apparatus according to the invention makes it possible not only to always perform a correct sewing of two or more textile articles, but also to check if the operating steps, for making a pantyhose article through the union of two stockings, are properly carried out. In fact, it is possible to assign an identifying code to any pair of shapes (3) of the line-closer machine and to record the codes of all the pairs of shapes into the memory of the programmable unit (5) in order to detect each time the transit of said shapes in front of the seamer (1). Should the misfit of stocking (2) (which would mean the seamer moving in the directions of arrows D and V) be always related to the same pair of shapes (3), as detected by the respective identification code, this would be very likely due to a malfunction of the same shapes (3). Should the misfit be of general and random character, that is, independent of a particular pair of shapes (3), this would very likely arise either from a malfunction of the means which operate the positioning of the stockings and/or of the means which operate the longitudinal cut thereof in correspondence of the bodice portion, or from the very knitting of the stockings fed to the line-closer.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. A method for sewing two or more textile articles having leg portions, the method comprising the steps of:

loading and positioning the articles on relevant supports which, during the sewing, are moved relative to a reamer so as to cause the leg portions of the articles to be sewn to transit in front of a needle of the reamer;

throughout the sewing maintaining an outer edge of the leg portions of articles to be sewn inside an optical control port (Z) facing the needle of the reamer and extending in a direction substantially orthogonal to a direction of transit of the articles;

moving the seamer away from the supports of the articles thereof when said outer edge of said leg portions goes beyond said control port and moving the seamer closer to the supports of the articles when the outer edge of said leg portions of articles is at a distance from said control port.

2. A method according to claim 1, wherein said articles are stockings.

3. An apparatus for sewing the legs of two or more textile articles, comprising a support for the articles;

a seamer with a needle, the seamer being movable relative to the support along a path having a predetermined transit direction;

an optical control port provided with the seamer and having a preset width, located at a position facing the needle of the seamer and extending in a direction substantially orthogonal to the transit direction in a sewing position;

a programable electronic unit, said control port being connected to said programmable electronic unit;

a step by-step motor connected for moving the seamer away from and toward the support in the process of formation according to the instantaneous position of the outer edge of the articles to be sewn with respect of said control port.

4. The apparatus according to claim 3, wherein said optical control port includes two photocells and the dimension of said control port is defined by the optical axes of said two photocells.

* * * * *